US007898234B1

(12) United States Patent
Lash et al.

(10) Patent No.: US 7,898,234 B1
(45) Date of Patent: Mar. 1, 2011

(54) DEVICE AND METHOD FOR RAPID VOLTAGE RAMP-UP TO REGULATOR TARGET VOLTAGE

(75) Inventors: Steven J. Lash, Leander, TX (US); Glenroy A. Devonish, Austin, TX (US)

(73) Assignee: Dell Products, LP, Round Rock, TX (US)

( * ) Notice: Subject to any disclaimer, the term of this patent is extended or adjusted under 35 U.S.C. 154(b) by 516 days.

(21) Appl. No.: 11/512,780

(22) Filed: Aug. 30, 2006

(51) Int. Cl.
*G05F 1/40* (2006.01)
*G05F 1/00* (2006.01)

(52) U.S. Cl. ..... 323/284; 323/288

(58) Field of Classification Search ..... 323/242, 323/222, 262, 315, 229, 235, 284, 908, 901, 323/282, 285, 288
See application file for complete search history.

(56) References Cited

U.S. PATENT DOCUMENTS 3,781,677 A * 12/1973 Hagen ..... 324/76.66
5,122,724 A * 6/1992 Criss ..... 323/222
5,461,301 A * 10/1995 Truong ..... 323/207
6,392,904 B1 * 5/2002 Bayer et al. ..... 363/59
6,661,211 B1 12/2003 Currelly et al.
6,807,039 B2 10/2004 Priest
6,825,644 B2 11/2004 Kernahan et al.
6,831,447 B1 * 12/2004 Wittenberg ..... 323/222
6,894,928 B2 5/2005 Owen
6,975,098 B2 * 12/2005 Vinciarelli ..... 323/266
6,979,987 B2 12/2005 Kernahan et al.
2006/0152954 A1 * 7/2006 Jovanovic et al. ..... 363/89

* cited by examiner

*Primary Examiner*—Adolf Berhane
*Assistant Examiner*—Emily Pham
(74) *Attorney, Agent, or Firm*—Larson Newman & Abel, LLP

(57) ABSTRACT

A voltage regulator includes a regulator output and an output capacitor and a variable-conductivity device in series connection between the regulator output and a voltage reference. The variable-conductivity device is configured to have an initial conductivity. A current then is provided at the regulator output in response to a power-on event. A conductivity of the variable-conductivity device is gradually increased from the initial conductivity in response to the current at the regulator output. In another implementation, a voltage regulator includes a regulator output coupled to a voltage rail to provide a current. The voltage regulator includes a capacitive circuit including an output capacitor and a variable-conductivity device coupled in series between the regulator output and a voltage reference. The voltage regulator includes an adjustment circuit configured to gradually increase a conductivity of the variable-conductivity device in response to an application of the current at the regulator output.

19 Claims, 2 Drawing Sheets

DEVICE AND METHOD FOR RAPID VOLTAGE RAMP-UP TO REGULATOR TARGET VOLTAGE

FIELD OF THE DISCLOSURE

This disclosure relates generally to voltage regulation, and more particularly to voltage ramp-up to a target voltage at a power-on event.

BACKGROUND

Information handling systems often utilize multiple voltage regulators to provide power to various sub-systems. In order to replenish the high-frequency current delivered by small value decoupling capacitors at the load, a voltage regulator often employs a bulk capacitor at its output to store charge and supply outrush current from the stored charge to the decoupling capacitors in response to an increase in the current load for the purpose of reducing voltage droop at the output of the voltage regulator. The presence of this bulk capacitor at the output of the voltage regulator is a significant inhibitor of a rapid ramp-up of the output voltage to a target voltage due to the inrush current to the bulk capacitor at start-up for the purpose of charging the bulk capacitor. As different voltage regulators in an information handling system may have different performance characteristics, including different output voltages and bulk capacitances at their outputs, the voltage ramp-up rates of the voltage regulators in an information handling system can vary significantly. In many instances, those components of the information handling system that utilize power from two or more voltage regulators can be damaged if the supplied voltages are not ramped to their corresponding target voltages at equivalent rates during start-up. Typically, a disparity between the rate at which one voltage ramps up and the rate at which another voltage ramps up can result in reverse biasing of one or more devices of a multiple-voltage component. This reverse bias condition can permanently damage the devices depending on the difference between the voltages and its duration.

One conventional technique to prevent reverse biasing due to disparities between voltage regulator ramp-up rates is to sequence the voltage regulators such that each voltage regulator ramps up its output voltage in turn. This conventional technique often is disadvantageous due to the relatively long start-up time resulting from the accumulation of ramp-up times. Further, additional sequencing control circuitry is required to affect the sequencing, thereby increasing the complexity, power consumption, and cost of the information handling system. Another conventional technique to prevent reverse biasing includes synchronizing the voltage regulators such that each of their outputs are connected to a common voltage rail during their voltage ramp-up and then releasing each voltage regulator's connection to the common voltage rail after the target voltage for the voltage regulator has been reached. This conventional technique typically requires costly pass elements to connect the voltage regulators to the common voltage rail, thereby increasing the complexity and cost of the system. Further, this conventional technique requires substantial time for voltage ramp-up so as to allow the bulk capacitors to charge up. Accordingly, an improved technique for voltage ramp-up of a voltage regulator would be advantageous.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. For example, much of the following focuses on voltage regulation in information handling systems. However, other teachings may certainly be utilized in this application. The teachings may also be utilized in other applications and with several different types of architectures such as distributed computing architectures, client/server architectures, or middleware server architectures and associated components.

In accordance with one aspect of the present disclosure, a method is provided for a voltage regulator including a regulator output and including an output capacitor and a variable-conductivity device in series connection between the regulator output and a voltage reference. The method includes configuring the variable-conductivity device to have an initial conductivity and providing a current at the regulator output in response to a power-on event. The method further includes gradually increasing a conductivity of the variable-conductivity device from the initial conductivity in response to the current at the regulator output.

In accordance with another aspect of the present disclosure, a voltage regulator is provided. The voltage regulator includes a regulator output to provide a current, the regulator output configured to couple to a voltage rail, a capacitive circuit including an output capacitor and a variable-conductivity device coupled in series between the regulator output and a voltage reference. The voltage regulator further includes an adjustment circuit configured to gradually increase a conductivity of the variable-conductivity device in response to an application of the current at the regulator output.

In accordance with yet another aspect of the present disclosure, an information handling system is provided. The information handling system includes a power supply having an output to provide an output voltage, a printed circuit board, and a voltage regulator. The voltage regulator includes a regulator input coupled to the output of the power supply, a regulator output to provide a current to a voltage rail of the printed circuit board, and a voltage stabilization circuit. The voltage stabilization circuit includes an output capacitor and a switching circuit to increase a charging current from the regulator output to the output capacitor in response to an application of the current to the regulator output.

Figure 1:
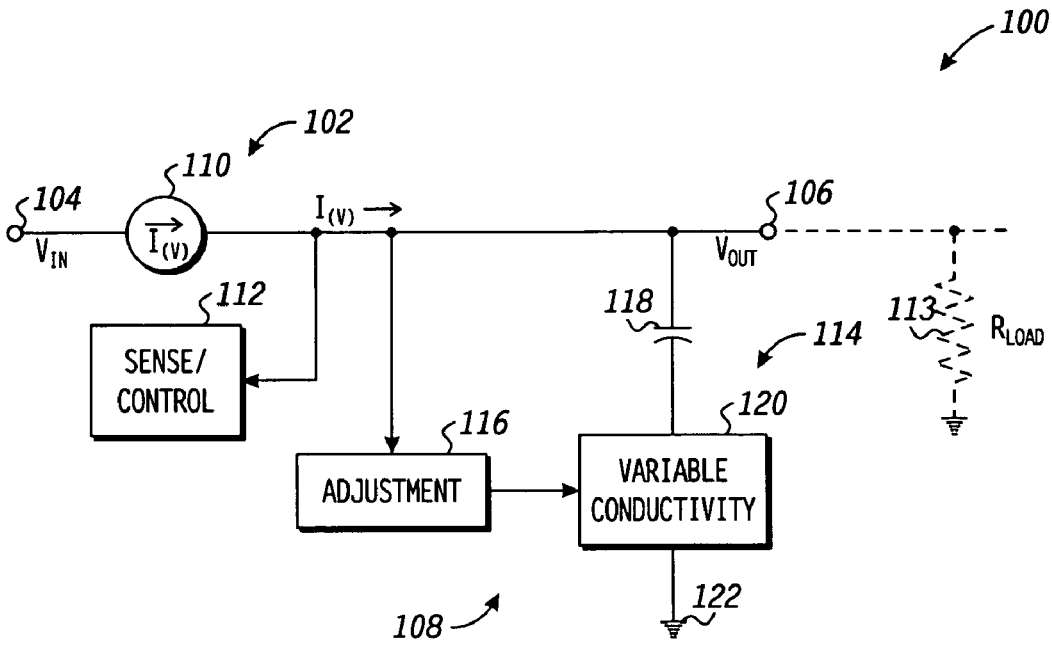
FIG. 1 is a schematic diagram illustrating a voltage regulator in accordance with one embodiment of the present disclosure.

FIG. 1 illustrates a voltage regulator 100 in accordance with at least one embodiment of the present disclosure. As illustrated, the voltage regulator 100 includes a voltage regulation circuit 102 having a regulator input 104 to receive a voltage $V_{IN}$ and a regulator output 106 configured to connect to one or more voltage rails (not shown) to provide a current I(v) so as to result in a voltage $V_{OUT}$ at the one or more voltage rails. The voltage regulator 100 further includes a voltage stabilization circuit 108 connected to the regulator output 106 for at least the purpose of stabilizing the voltage $V_{OUT}$ in response to varying load conditions.

The voltage regulation circuit 102 includes a voltage-dependent current source 110 and a sense/control circuit 112. The voltage-dependent current source 110 includes an input connected to the regulator input 104 to receive the voltage $V_{IN}$ and an output connected to the regulator output 106 to provide a current I(v) to the regulator output 106, whereby the voltage $V_{OUT}$ at the regulator output 106 is based on the current I(v) and the resistance 113 ($R_{LOAD}$) of the load components connected to the one or more voltage rails (i.e., $V_{OUT}$=I(v) *$R_{LOAD}$ at steady-state). The sense/control circuit 112 includes an input connected to the regulator output 106 to detect the voltage $V_{OUT}$ and an output connected to the voltage-dependent current source 110 to control the current I(v) output by the voltage-dependent current source 110. The sense/control circuit 112 detects the voltage $V_{OUT}$ at the regulator output 106 and compares the voltage $V_{OUT}$ with a predetermined target voltage $V_T$. In the event that the voltage $V_{OUT}$ falls below the target voltage $V_T$ the sense/control circuit 112 controls the voltage-dependent current source 110 to increase the current I(v) so as to increase the voltage $V_{OUT}$. Conversely, when the voltage $V_{OUT}$ exceeds the target voltage $V_T$, the sense/control circuit 112 controls the voltage-dependent current source 110 to decrease the current I(v) so as to decrease the voltage $V_{OUT}$.

The voltage stabilization circuit 108 includes a capacitive circuit 114 and an adjustment circuit 116. The capacitive circuit 114 includes an output capacitor 118 (e.g., a single capacitor or a network of capacitors) and a variable-conductivity device 120 connected in series between the regulator output 106 and another voltage reference having a lower voltage potential than the regulator output 106 during steady-state operation, such as, for example, ground 122. The adjustment circuit 116 and the variable-conductivity device 120 together comprise a switching circuit for the output capacitor 118. Although the output capacitor 118 is depicted as being connected between the variable-conductivity device 120 and the regulator output 106 in the illustrated embodiment, in another embodiment, the relative positions of the output capacitor 118 and the variable-conductivity device 120 can be switched so that the variable-conductivity device 120 is connected between the output capacitor 118 and the regulator output 106. The adjustment circuit 116 includes an input connected to the regulator output 106 and an output connected to the variable-conductivity device 120 so as to control the conductivity of the variable-conductivity device 120.

In one embodiment, the voltage regulator 100 operates in two modes: a steady-state mode and a start-up mode. During the steady-state mode, the voltage $V_{OUT}$ has ramped up to or near the target voltage $V_T$ and the output capacitor 118 is sufficiently charged so as to provide an outrush current $I_{OUT}$ to supplement the current I(v) in response to transient change in the load resistance 113 so that the voltage $V_{OUT}$ remains relatively constant. During the steady-state mode, the adjustment circuit 116 sets the variable-conductivity device 120 to a high conductivity state so as to reduce or minimize the voltage drop between the anode of the output capacitor 118 and ground 122.

During the start-up mode, the voltage regulator 100 initiates the output of the current I(v) in response to a power-on event (such as the initial application of the voltage $V_{IN}$ to the regulator input 104). As discussed above, the sense/control circuit 112 controls the ramp up of the current I(v) so that the voltage $V_{OUT}$ generated due to the load resistance 113 approaches the target voltage $V_T$. However, it will be appreciated that the presence of the output capacitor 118 would slow the ramp up of the voltage $V_{OUT}$ due to capacitor charging if the output capacitor 118 were connected between the regulator output 106 and ground 122 in an unimpeded manner such that the full capacitance of the output capacitor 118 is observable at the regulator output 106 during the initial ramp-up. Accordingly, in one embodiment, the adjustment circuit 116 initially sets the variable-conductivity device 120 to its minimum conductivity so as to effectively disconnect the anode of the capacitor 118 from ground 122. The adjustment circuit 116 then detects the initial application of current at the regulator output 106 and in response to the initial application of current, gradually increases the conductivity of the variable-conductivity device 120 at a certain rate so as to gradually increase the connectivity between the anode of the output capacitor 118 and ground 122. As a result of the gradual increase in the conductivity of the variable-conductivity device 120, the retardation of the ramp-up of the voltage $V_{OUT}$ caused by the capacitive effect of the output capacitor 118 can be reduced or eliminated.

It will be appreciated that rapid changes in the conductivity of the variable-conductivity device 120, and thus rapid changes in the capacitive effect seen at the regulator output 106, can result in instability conditions, such as undershoot/overshoot oscillation, by the voltage regulation circuit 102 due to the loop response, or transient response, of the voltage regulation circuit 102. Accordingly, in one embodiment, is to control the rate at which the output capacitor 118 is switched to the regulator output 106 (i.e., the rate at which the conductivity of the variable-conductivity device 120 increases is compatible with the loop response of the voltage regulator 100, thereby reducing the possibility of the voltage regulation circuitry 102 from becoming unstable.

By gradually increasing the capacitance observed at the regulator output 106 during the start-up mode, the voltage $V_{OUT}$ can more rapidly ramp up to the target voltage $V_T$ than otherwise could be achieved in an implementation whereby the output capacitor is statically connected to the regulator output. As a result of this improved ramp-up rate, the reliance on the conventional techniques of voltage regulator sequencing or voltage regulator synchronizing can be reduced or eliminated in multiple voltage implementations.

Figure 2:
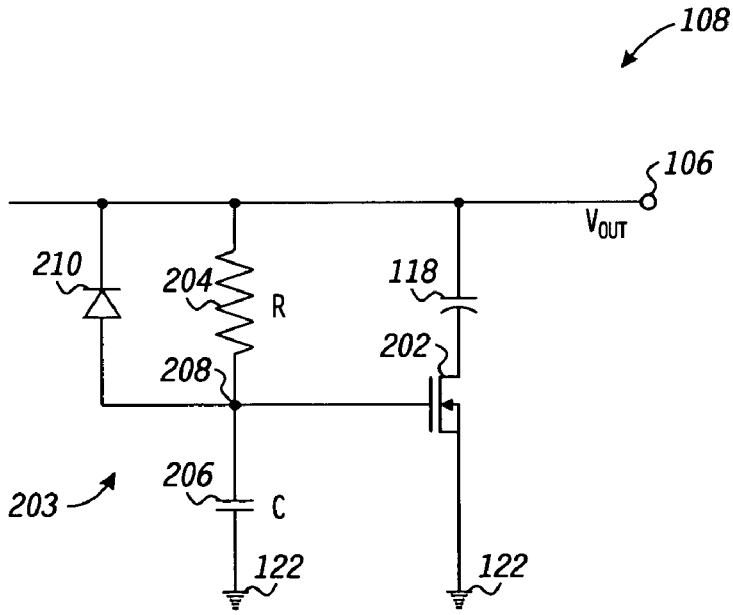
FIG. 2 is a schematic diagram illustrating a particular implementation of a voltage stabilization circuit of the voltage regulator of FIG. 1 in accordance with at least one embodiment of the present disclosure.

FIG. 2 illustrates a particular implementation of the voltage stabilization circuit 108 of the voltage regulator 100 of FIG. 1 in accordance with at least one embodiment of the present disclosure. In the depicted example, the variable-conductivity device 120 (FIG. 1) is implemented as a transistor 202. As illustrated, in one embodiment, the transistor 202 is used to connect the negative electrode of the output capacitor 118 to a voltage reference (e.g., ground 122) and therefore includes a current electrode connected to the negative electrode of the output capacitor 118 and a current electrode connected to ground 122, and the positive electrode of the output capacitor 118 is connected to the regulator output 106. In an alternate embodiment, the transistor 202 can connect the positive electrode of the output capacitor 118 to the regulator output 106 and therefore can include a current electrode connected to the positive electrode of the output capacitor 118, a current electrode connected to the regulator output 106, and whereby the negative electrode of the output capacitor 118 is connected to ground 122. The transistor 202 can include, for example, a Bipolar Junction Transistor (BJT), a Field Effect Transistor (FET), or any of a variety of transistors whereby their conductivity between current electrodes is based on the voltage or current at the control electrode.

As also illustrated, in a particular implementation, the adjustment circuit 116 (FIG. 1) includes a resistive-capacitive circuit (RC) circuit 203 including a resistor 204 having a resistance R and a capacitor 206 having a capacitance C. The resistor 204 can include a single resistor or a network of resistors. Further, the resistor 204 further can include a variable resistor or switchable resistive network adjustable via mechanical or electrical switching means. Likewise, the capacitor 206 can include a single capacitor or a network of capacitors, and further may include a variable capacitor or switchable capacitor network adjustable via mechanical or electrical switching means. As shown, the resistor 204 has an electrode connected to the regulator output 106 and an electrode connected to the control electrode of the transistor 202, and the capacitor 206 includes an electrode connected to the control electrode of the transistor 202 and an electrode connected to ground 122. In an alternate embodiment, the relative connections of the resistor 204 and the capacitor 206 can be switched.

Upon initial application of the current I(v) (FIG. 1) to the regulator output 106, the RC circuit 203 begins to charge the capacitor 206 via the resistor 204, whereby the rate at which the voltage across the capacitor 206 increases, and therefore rate at which the voltage at the node 208/the control electrode of the transistor 202 increases relative to the source current electrode, is based on the resistance R and capacitance C of the RC circuit 203 Further, it will be appreciated that the conductivity between the current electrodes of the transistor 202 is dependent on the voltage at the control electrode (or, more specifically, the voltage difference between the voltage at the control electrode and the voltage at the source current electrode of the transistor 202). Accordingly, the transistor 202 is set at an initial conductance based on the voltage across the capacitor 206 at the initial application of the current I(v). In the event that the capacitor 202 has fully discharged, the voltage across the capacitor 206 would be essentially near-ground and the conductivity of the transistor 202 therefore would be zero or near-zero.

Further, the rate at which the conductivity of the transistor 202 increases from the initial conductivity is based on (e.g., substantially proportional) to the rate at which the capacitor 206 is charged. Further, as described above, the rate at which the conductivity of the transistor 202 (as the variable-conductivity device 120) increases controls the rate at which the capacitance of the output capacitor 118 is switched to the regulator output 106. Thus, in one embodiment, the resistance R and the capacitance C can be selected to set the switching time delay ($\tau$=RC) of the RC circuit 203 and transistor 202 sufficiently slow enough such that the regulator output 106 can rapidly ramp up its output voltage $V_{OUT}$ to the target voltage $V_T$ while permitting substantially all of the capacitance of the output capacitor 118 to be accessible at the regulator output 106 after the output voltage $V_{OUT}$ is sufficiently close to the target voltage $V_T$. Further, the resistance R and the capacitance C can be selected so as to be compatible with the loop response of the voltage regulation circuit 102 (FIG. 1), thereby reducing or eliminating a slow voltage output ramp up and the possibility of overshoot/undershoot oscillation due to the changing capacitance at the regulator output 106 caused by the gradual switching of the output capacitor 118 to the regulator output 106.

The resistance R and the capacitance C can be selected based on desired ramp-up criteria and implemented as a fixed resistor and a fixed capacitor by the manufacturer of the voltage regulator 100 or the manufacturer of a system implementing the voltage regulator 100. Alternately, the resistance R and the capacitance C can be variable by mechanical or electrical means and therefore can be initially set by a user or supplier of the voltage regulator 100. Further, the resistance R and capacitance C can be dynamically adjusted depending on, for example, a predicted use or implementation of the voltage regulator 100 or depending on, for example, a dynamic feedback mechanism whereby the voltage ramp-up performance is monitored and the resistance R and the capacitance C are adjusted accordingly.

After the capacitor 206 is sufficiently charged, the transient current through the RC circuit 203 approaches zero and the voltage at the node 208, and thus the conductivity of the transistor 202, enters a steady state. At this point, the output capacitor 118 is effectively connected to ground 122 (assuming a high conductivity of the transistor 202 at the steady-state voltage of the node 208) and the output capacitor 118 therefore can provide supplemental outrush current from its stored charge so as to reduce or eliminate voltage droop due to variations in load resistance.

Upon termination of the application of the current I(v) at the regulator output 106 (e.g., after shut-down), the capacitor 206 may gradually discharge over a certain period, as may the output capacitor 118. Accordingly, in the event that the voltage regulator 100 is restarted before the capacitor 206 has fully discharged, the voltage across the capacitor 206 may be at a non-zero voltage and the transistor 202 therefore may be more conductive at the initial application of the current I(v) than it would have been had the capacitor 206 been fully discharged and thus the switching delay provided by the transistor 202 may be shortened. In instances where it may be desirous or advantageous to maintain a consistent rate of introduction of the capacitance of the output capacitor 118, the adjustment circuit 116 can further implement a diode 210 having a cathode electrode connected to the regulator output 106 and an anode electrode connected to the node 208. Upon termination of the current I(v) at the regulator output 106, the voltage $V_{OUT}$ drops below the voltage at the node 208 caused by the stored charge in the capacitor 206, thereby causing the diode 210 to become forward biased. When the diode 210 is forward biased, the charge drains from the capacitor 206 to the regulator output 206, thereby causing the voltage at the control electrode of the transistor 202 to drop, which in turn causes the conductivity of the transistor 202 to decrease.

Figure 3:
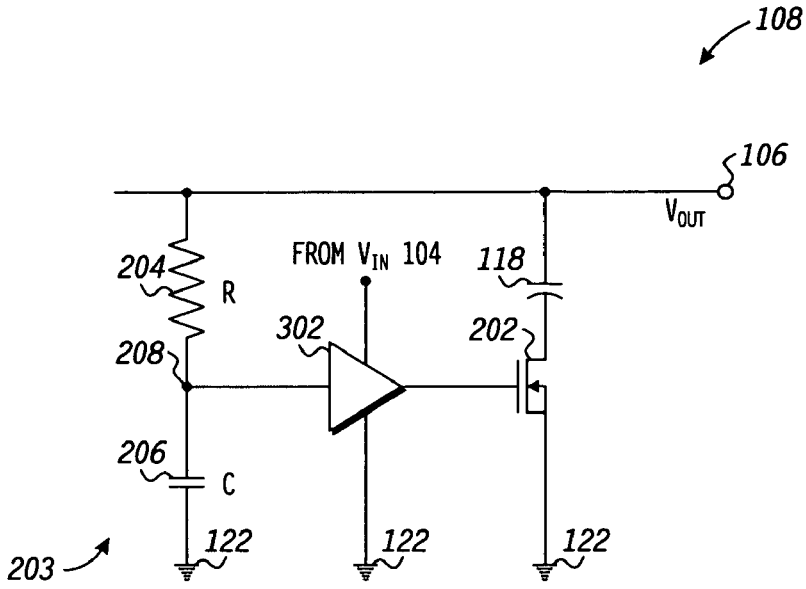
FIG. 3 is a schematic diagram illustrating another particular implementation of the voltage stabilization circuit of the voltage regulator of FIG. 1 in accordance with at least one embodiment of the present disclosure.

FIG. 3 illustrates another particular implementation of the voltage stabilization circuit 108 of the voltage regulator 100 of FIG. 1 in accordance with at least one embodiment of the present disclosure. The depicted example of FIG. 3 is similar to the implementation of FIG. 2 in that the variable-conductivity device 120 (FIG. 1) is implemented as the transistor 202 and the adjustment circuit 116 (FIG. 1) is implemented as the RC circuit 203 having the resistance element 204 and the capacitor 206.

It will be appreciated that many of the potential transistors that can be utilized as the transistor 202 have a switching voltage of approximately 2-3 volts (V). Accordingly, in low-voltage implementations whereby the voltage regulator 100 is utilized to provide an output voltage $V_{OUT}$ below the switching voltage of the transistor 202 (e.g., below 3V), the voltage stability circuit 108 further can include an active circuit to provide a switching voltage to the control electrode of the transistor 202 that is higher than the output voltage $V_{OUT}$ supplied by the regulator output 106. As depicted by FIG. 3, this active circuitry can be implemented as an amplifier circuit 302 (e.g., an operational amplifier or op-amp) having a signal input connected to the node 208 and an amplified signal output connected to the control electrode of the transistor 202, and further having a power input connected to a voltage source with a voltage at or higher than the switching voltage of the transistor 203 (e.g., connected to the regulator input 104 of the voltage regulator 100, FIG. 1). The amplifier circuit 302 therefore can amplify the voltage at the node 208 so as to facilitate activation of the transistor 202 when the voltage input to the RC circuit 203 (e.g., output voltage $V_{OUT}$) is at or less than the switching voltage of the transistor 202.

Figure 4:
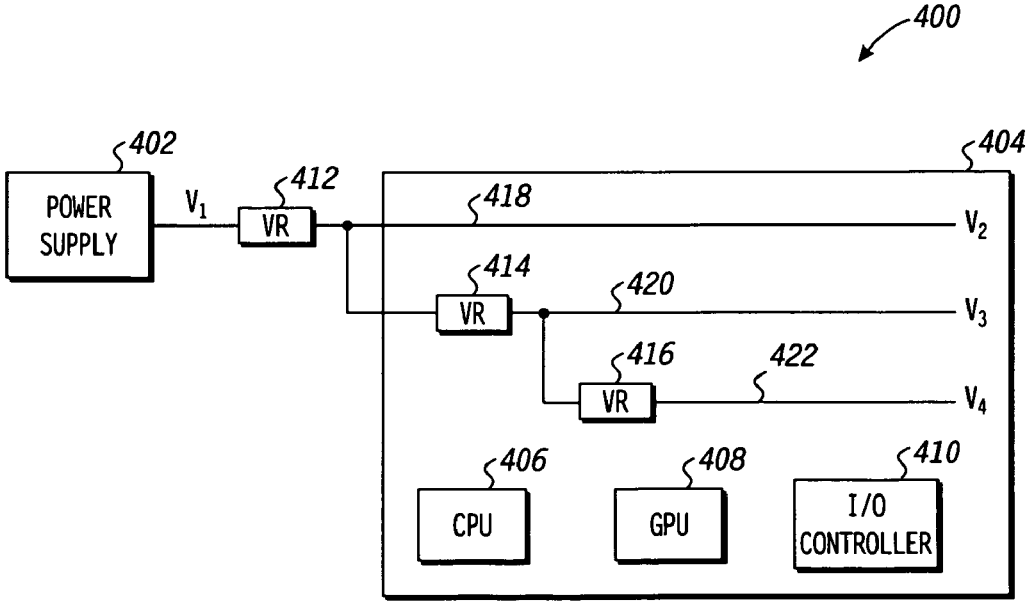
FIG. 4 is a block diagram illustrating an information handling system utilizing cascaded voltage regulators in accordance with at least one embodiment of the present disclosure.

Although FIGS. 3 and 4 illustrate particular implementations of the adjustment circuit 116 (FIG. 1) and the variable-conductivity device 120 (FIG. 1), other implementations may be used without departing from the scope of the present disclosure. To illustrate, the adjustment circuit 116 could be implemented as a counter having an output connected to the input of a digital-to-analog converter (DAC), which in turn has an output connected to the control electrode of the transistor. In response to a power-on event, the counter can reset and then increment in response to a clock signal. The count of the counter is then converted to a corresponding voltage by the DAC; which is applied to the control electrode of the transistor 202. Thus, as the count gradually increments, so does the conductivity of the transistor 202.

FIG. 4 illustrates a particular implementation of an information handling system 400 utilizing cascaded voltage regulators in accordance with at least one embodiment of the present disclosure. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network server or storage device, a switch router or other network communication device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

The information handling system 400 includes a power supply 402 and a motherboard 404 or other printed circuit board (PCB). The motherboard 404 includes a plurality of information handling components, such as a central processing unit (CPU) 406, a graphics processing unit (GPU) 408, an input/output (I/O) controller 410, and the like. The information handling system 400 further includes voltage regulators 412, 414, and 416. The voltage regulator 412 has an input to receive a voltage $V_1$ provided by the power supply 402 and an output connected to a voltage rail 418 to provide a voltage $V_2$. The voltage regulator 414 has an input coupled to the voltage rail 418 to receive the voltage $V_2$ and an output coupled to a voltage rail 420 to provide a voltage $V_3$. The voltage regulator 416 includes an input coupled to the voltage rail 420 to receive the voltage $V_3$ and an output connected to a voltage rail 422 to provide a voltage $V_4$. The information handling components of the motherboard 404 are connected to one or more of the voltage rails 418, 420, and 422.

In at least one embodiment, the voltage regulators 412, 414, and 416 implement the voltage stabilization circuit 108 as described above with reference to FIGS. 1-3. Accordingly, due to the comparably fast voltage ramp-up rates afforded by the disconnection and gradual introduction of the output capacitor provided by the voltage stabilization circuit 108, a relatively small delay may occur between the voltage ramp-ups of each of the voltage regulators 412, 414, and 416, thereby reducing or eliminating the potential for reverse biasing in the information handling components due to mismatches between the voltages at the voltage rails 418, 420, and 422. Further, because the voltage stabilization circuit 108 effectively disconnects the output capacitor at the outputs of each of the voltage regulators 412, 414, and 416 at the start of the voltage ramp-up, the inrush currents that otherwise would be needed to charge the output capacitors at downstream voltage regulators can be effectively reduced, thereby reducing the potential for significant voltage droop at the output of an upstream voltage regulator.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. In a voltage regulator comprising a regulator output and comprising an output capacitor and a variable-conductivity device in series connection between the regulator output and a voltage reference, a method comprising:

configuring the variable-conductivity device to have an initial conductivity;

providing a current at the regulator output in response to a power-on event;

detecting, at an adjustment circuit, an initial application of a current at the regulator output;

gradually increasing a conductivity of the variable-conductivity device from the initial conductivity at a predetermined rate that is compatible with a loop response of the voltage regulator, wherein the predetermined rate is set by the adjustment circuit in response to the initial application of the current at the regulator output;

providing a feedback signal to a voltage dependent current source based on a difference between an output voltage and a desired voltage; and varying the current at the regulator output based on the feedback signal received at the voltage dependent current source.

2. The method of claim 1, wherein the initial conductivity comprises a near-zero conductivity.

3. The method of claim 1, wherein the variable-conductivity device comprises a transistor and wherein gradually increasing the conductivity of the variable-conductivity device comprises gradually increasing a voltage applied to a control electrode of the transistor.

4. The method of claim 3, wherein gradually increasing the voltage applied to the control electrode of the transistor comprises gradually increasing the voltage applied to the control electrode via a resistance-capacitance (RC) circuit coupled to the control electrode.

5. The method of claim 4, wherein the predetermined rate is also based on a resistance and a capacitance of the RC circuit and a transient response of the voltage regulator.

6. The method of claim 5, further comprising:

determining a select resistance and a select capacitance based on a desired rate for the predetermined rate; and providing the RC circuit having the select resistance and the select capacitance.

7. A voltage regulator comprising:

a regulator output to provide a current, the regulator output configured to couple to a voltage rail;

a sense/control circuit configured to provide a feedback signal based on a difference between an output voltage of the voltage regulator and a desired voltage;

a voltage dependent current source configured to vary the current provided by the regulator output based on the feedback signal received from the sense/control circuit;

a capacitive circuit comprising an output capacitor and a variable-conductivity device coupled in series between the regulator output and a voltage reference; and an adjustment circuit configured to detect an initial application of the current at the regulator output, and to gradually increase a conductivity of the variable-conductivity device at a predetermined rate that is compatible with a loop response of the voltage regulator in response to the initial application of the current at the regulator output, wherein the predetermined rate is set in response to the initial application of the current.

8. The voltage regulator of claim 7, wherein the variable-conductivity device comprises a transistor having a first current electrode coupled to an electrode of the output capacitor, a second current electrode coupled to one of the regulator output or the voltage reference, and a control electrode, wherein a conductivity of the transistor is based on a voltage at the control electrode.

9. The voltage regulator of claim 8, wherein the transistor comprises one of: a bi-polar junction transistor; and a field effect transistor.

10. The voltage regulator of claim 8, wherein the adjustment circuit comprises a resistor-capacitor (RC) circuit having a first node coupled to the regulator output, a second node coupled to the voltage reference, and a third node coupled to the control electrode of the transistor.

11. The voltage regulator of claim 10, wherein the first node comprises a first electrode of a resistor of the RC circuit and the second node comprises a first electrode of a capacitor of the RC circuit, and wherein the third node comprises a node coupling a second electrode of the resistor and a second electrode of the capacitor to the control electrode of the transistor.

12. The voltage regulator of claim 11, further comprising a diode having a cathode electrode coupled to the regulator output and an anode electrode coupled to the third node of the RC circuit.

13. The voltage regulator of claim 10, wherein the first node comprises a first electrode of a capacitor of the RC circuit and the second node comprises a first electrode of a resistor of the RC circuit, and wherein the third node comprises a node coupling a second electrode of the resistor and a second electrode of the capacitor to the control electrode for the transistor.

14. The voltage regulator of claim 11, further comprising:

a voltage amplification circuit comprising an input coupled the third node and an output coupled to the control node of the transistor.

15. An information handling system comprising:

a power supply having an output to provide a first output voltage;

a printed circuit board;

a first voltage regulator comprising:

a first regulator input coupled to the output of the power supply;

a first regulator output to provide a first current to a first voltage rail of the printed circuit board;

a sense/control circuit coupled to the first regulator output, the sense/control circuit configured to provide a feedback signal based on a difference between an output voltage of the voltage regulator and a desired voltage;

a voltage dependent current source configured to vary the first current provided by the first regulator output based on the feedback signal received from the sense/control circuit; and a first voltage stabilization circuit comprising a first output capacitor and a first switching circuit to increase a charging current from the first regulator output to the first output capacitor in response to detecting an initial application of the first current to the first regulator output, wherein the charging current is changed at a predetermined rate that is compatible with a loop response of the first voltage regulator and the predetermined rate is set in response to the initial application of the first current.

16. The information handling system of claim 15, further comprising:

a second voltage regulator disposed at the printed circuit board, the second voltage regulator comprising:

a second regulator input coupled to the first voltage rail;

a second regulator output to provide a second current to a second voltage rail of the printed circuit board; and a second voltage stabilization circuit comprising a second output capacitor and a second switching circuit to gradually increase a charging current from the second regulator output to the second output capacitor in response to an application of the second current to the second regulator output, wherein the charging current is changed at a predetermined rate that is compatible with a loop response of the second voltage regulator.

17. The information handling system of claim 15, wherein the first switching circuit comprises:

a transistor having a first current electrode coupled to an electrode of the first output capacitor, a second current electrode coupled to a voltage reference, and a control electrode, wherein a conductivity of the transistor is based on a voltage at the control electrode; and a resistive-capacitive (RC) circuit comprising:

a resistor having a first electrode coupled to the first regulator output and a second electrode coupled to the control electrode; and a capacitor having a first electrode coupled to the control electrode and a second electrode coupled to the voltage reference.

18. The information handling system of claim 17, further comprising:

a diode having a cathode electrode coupled to the first regulator output and an anode electrode coupled to the first electrode of the capacitor.

19. The information handling system of claim 15, wherein the printed circuit board comprises a motherboard.

* * * * *